US010589411B2

(12) United States Patent
Schulz et al.

(10) Patent No.: US 10,589,411 B2
(45) Date of Patent: Mar. 17, 2020

(54) HANDHELD WORK APPARATUS

(71) Applicant: Andreas Stihl AG & Co. KG, Waiblingen (DE)

(72) Inventors: Andreas Schulz, Ettlingen (DE); Ralf Blechschmidt, Kernen (DE)

(73) Assignee: Andreas Stihl AG & Co. KG, Waiblingen (DE)

( * ) Notice: Subject to any disclaimer, the term of this patent is extended or adjusted under 35 U.S.C. 154(b) by 115 days.

(21) Appl. No.: 15/943,650

(22) Filed: Apr. 2, 2018

(65) Prior Publication Data

US 2018/0281167 A1 Oct. 4, 2018

(30) Foreign Application Priority Data

Mar. 31, 2017 (EP) ..... 17000541

(51) Int. Cl.

| | |
|---|---|
| ***B25F 5/02*** | (2006.01) |
| ***B25F 5/00*** | (2006.01) |
| ***B27B 17/00*** | (2006.01) |
| ***H01H 1/20*** | (2006.01) |
| *F02D 11/04* | (2006.01) |

(52) U.S. Cl.

CPC ..... *B25F 5/006* (2013.01); *B25F 5/02* (2013.01); *B27B 17/0008* (2013.01); *H01H 1/20* (2013.01); *B27B 17/00* (2013.01); *B27B 17/0033* (2013.01); *F02D 11/04* (2013.01)

(58) Field of Classification Search

CPC .... B25D 17/043; B23D 57/023; B27B 17/00; B27B 17/02; B27B 17/0008; B27B 17/0033; B27B 17/0083; B25F 5/02; B25F 5/001; B25F 5/006; F02D 11/02; F02D 11/04

USPC ..... 173/162.2, 170, 162.1, 210, 169, 171, 173/217; 30/381, 382, 383, 296.1

See application file for complete search history.

(56) References Cited

U.S. PATENT DOCUMENTS 4,785,539 A * 11/1988 Nagashima ..... B27B 17/0008 30/381
4,896,425 A * 1/1990 Henriksson ..... B27B 17/00 123/400
5,029,393 A * 7/1991 Nagashima ..... B27B 17/00 30/381

(Continued)

FOREIGN PATENT DOCUMENTS

EP 2251152 A1 11/2010

*Primary Examiner* — Scott A Smith
(74) *Attorney, Agent, or Firm* — Walter Ottesen, P.A.

(57) ABSTRACT

A work apparatus has a first and a second assembly. The second assembly is mounted movably in relation to the first assembly via at least one antivibration element. Formed between the first assembly and the second assembly is a vibration gap, which is bridged by the antivibration element. The work apparatus has a switch, for actuation by an operator, which includes a first contact element and a second contact element. When the switch is closed, the first contact element and the second contact element contact each other. When the switch is open, the first and second contact element do not establish an electrically conductive contact. The second contact element is part of the second assembly. The first contact element is part of the first assembly and, when the switch is closed, the first contact element and the second contact element bridge the vibration gap between the first and second assembly.

18 Claims, 7 Drawing Sheets

(56) References Cited

U.S. PATENT DOCUMENTS

| | | | | |
|---|---|---|---|---|
| 5,209,196 | A * | 5/1993 | Nickel | F02D 11/02 123/179.18 |
| 6,766,868 | B2 | 7/2004 | Frauhammer et al. | |
| 7,269,904 | B2 * | 9/2007 | Schmidt | B27B 17/00 173/170 |
| 7,958,946 | B2 | 6/2011 | Kurzenberger et al. | |
| 8,134,093 | B2 | 3/2012 | Loew et al. | |
| 2005/0183270 | A1 * | 8/2005 | Schmidt | B27B 17/00 30/381 |
| 2008/0277130 | A1 * | 11/2008 | Kurzenberger | B25F 5/006 173/162.2 |
| 2009/0064504 | A1 * | 3/2009 | Kodama | A01G 3/053 30/296.1 |
| 2010/0193338 | A1 * | 8/2010 | Loew | H01H 1/18 200/335 |
| 2010/0224384 | A1 | 9/2010 | Gwosdz et al. | |
| 2010/0224466 | A1 | 9/2010 | Leinmueller et al. | |
| 2014/0174772 | A1 * | 6/2014 | Mandalka | B25F 5/02 173/1 |

* cited by examiner

HANDHELD WORK APPARATUS

CROSS REFERENCE TO RELATED APPLICATION

This application claims priority of European patent application no. 17 000 541.7, filed Mar. 31, 2017, the entire content of which is incorporated herein by reference.

BACKGROUND OF THE INVENTION

Known from United States Patent Application publication 2010/0224384 A1 is a handheld work apparatus having an internal-combustion engine, which has a short-circuit switch, to be actuated by the operator, for short-circuiting the ignition of the internal-combustion engine. Arranged on the engine housing of the work apparatus are contacts that, when an operator-controlled switch is in the off position, are connected to each other in an electrically conductive manner. The operator-controlled switch is pivotally mounted on the engine housing. The operator-controlled switch is also used to set the position of a throttle valve and a choke valve of a carburetor of the internal-combustion engine of the work apparatus. The carburetor is usually decoupled from the internal-combustion engine in respect of vibration via at least one antivibration element. Owing to the movement capability of the carburetor and the operator-controlled switch in relation to each other, the position of the operator-controlled switch relative to the carburetor can change during operation. As a result, it is not always possible for the position of the throttle valve and choke valve to be set with the required accuracy, in one or more start positions, via the operator-controlled switch.

It is also known to fix the operator-controlled switch, used for operator actuation of a short-circuit switch and for setting at least one start position of the throttle elements of a carburetor, relative to the carburetor. As a result, during operation the operator-controlled switch moves with the carburetor, such that precise setting of the positions of throttle elements of the carburetor in the start position is made possible. In the case of such an arrangement, the contacts, with which the operator-controlled switch acts in combination to form a short-circuit switch, are arranged on the carburetor. The contacts are connected to the ignition module of the internal-combustion engine, or to ground, via electric leads that are routed via the vibration gap. The laying of the electric leads requires a very large amount of assembly work during the production of the work apparatus. The electric leads are subjected to very high mechanical loads, owing to the relative movement of the carburetor and the internal-combustion engine. In the case of servicing work on the carburetor, it is usually necessary for the electric leads to be detached and re-laid following the service, necessitating an increased amount of work during servicing.

SUMMARY OF THE INVENTION

It is an object of the invention to provide a handheld work apparatus, in which the amount of work required for assembling and servicing is reduced.

This object can, for example, be achieved by a handheld work apparatus including: an anti-vibration element; a first assembly; a second assembly movably mounted with respect to the first assembly via the anti-vibration element; the first assembly and the second assembly conjointly defining a vibration gap therebetween; the anti-vibration element bridging the vibration gap; a switch configured to be actuated by an operator; the switch including at least one first contact element and at least one second contact element, wherein the at least one first contact element and the at least one second contact element are in contact when the switch is closed and the at least one first contact element and the at least one second contact element have no electrically conducting contact therebetween when the switch is open; the second contact element being part of the second assembly; at least one of the at least one first contact element being part of the first assembly; and, the at least one first contact element and the at least one second contact element being configured to bridge the vibration gap when the switch is closed.

It is provided that a first contact element is part of a first assembly, and a second contact element is part of a second assembly, and that, when the switch is closed, the contact elements bridge a vibration gap between the first assembly and the second assembly. Since the switch itself bridges the vibration gap, there is no need for electric leads that bridge the vibration gap. Contact elements of an electric switch can easily be configured such that, besides the usual production tolerances, the positional tolerances that ensue because of the relative movement over the vibration gap are also compensated. A simple and robust structure is thus obtained. Since there is no need for electric leads routed via the vibration gap, the amount of work required in assembling and servicing can be reduced.

Advantageously, the first contact element is formed by a first contact spring. Formed on the first contact spring, advantageously, is a support region of the first contact spring, by which the first contact spring is supported on the first assembly. Formed on the first contact spring, advantageously, is a fastening region of the first contact spring, at which the first contact spring is fixed to the first assembly. Advantageously, the support region and the fastening region are at a distance from each other, such that the contact springs can be realized such that they are free-springing in the region located between the support region and the fastening region. In the free-springing region, the first contact spring is not supported. In a preferred configuration, the first contact spring is made from an electrically conductive material, for example from metallic plate or sheet. Particularly preferably, the first contact spring is realized as an elongate, bent sheet. In a preferred configuration, the contact element acts on the contact spring in the longitudinal extent of the contact spring between the support region and the fastening region. Since the contact element acts on the first contact spring in the free-springing region, comparatively large deformations of the contact spring are possible, such that large positional tolerances can be compensated. Preferably, the contact element acts on the first contact spring in a middle portion between the support region and the fastening region. In this middle region, the greatest deformations of the first contact spring are possible.

The contact spring is preferably not supported between the support region and the fastening region. In a preferred configuration, the contact spring is biased, in particular in the direction of the contact element. Since the contact element acts on the contact spring between the support region and the fastening region, it can easily be ensured that an electrical contact reliably exists between the contact element and the first contact spring in any possible relative position of the first assembly and the second assembly in relation to each other. Between the fastening region and the support region, the first contact spring preferably has a free-springing spring region. The length of the free-springing spring region is preferably comparatively large. The length of the free-springing spring region, measured in the direction of the longitudinal extent, is preferably at least 10 mm, in particular at least 15 mm, preferably at least 20 mm.

Advantageously, a stop for the second contact element is realized on the first assembly. The spring region is preferably a free-springing spring region, which is arranged between the fastening region and the support region of the first contact spring. The stop advantageously limits the deflection of the first contact spring when the switch is closed. The limitation of the deflection in this case is effected by the limitation of the end position of the second contact element. The stop prevents the first contact spring from being inadmissibly deformed in the case of an unfavorable relative position of the first assembly and the second assembly in relation to each other upon closing of the switch. Permanent deformations of the first contact spring and, in particular, also permanent deformations of a second contact spring are thereby avoided in a simple manner.

Advantageously, the second contact element comes into contact with the first contact spring at a contact region of the spring region. In a preferred configuration, the contact region of the first contact spring is separated by a distance from the stop, in the direction of a longitudinal extent of the first contact spring. In an alternative configuration, however, it may also be provided that the contact region is located in the region of the stop, and is not separated by a distance from the stop in the direction of the longitudinal extent of the first contact spring.

It is advantageously provided that, when the switch is open, the first contact element is separated by a distance from the second contact element. It can thereby be ensured, in a simple manner, that the switch is not closed without actuation of the switch by the operator, that is, unintentionally, as a result of the relative movements between the first and the second assembly. When the switch is open, the distance between the first contact element and the second contact element is advantageously approximately 1.5 times to 3 times the maximum relative movement between the first assembly and the second assembly at the first contact element.

In a preferred configuration, the switch includes a third contact element, which is part of the first assembly. When the switch is closed, the third contact element is preferably connected in an electrically conductive manner to the first contact element via the second contact element. The second contact element accordingly establishes an electrically conductive connection between the first and the third contact element of the first assembly.

Advantageously, the third contact element is formed by a second contact spring. Formed on the second contact spring, advantageously, is a support region of the second contact spring. Via the support region of the second contact spring, the second contact spring is advantageously supported on the first assembly. Preferably, formed on the second contact spring is a fastening region of the second contact spring, at which the second contact spring is fixed to the first assembly. In a preferred configuration, the second contact spring is made of an electrically conductive material, for example of metallic plate or sheet. Particularly preferably, the second contact spring is realized as an elongate bent sheet. Preferably, the first contact spring and the second contact spring are realized so as to be at least partially identical. Particularly preferably, the first contact spring and the second contact spring are realized so as to be identical in their support region and in their free-springing spring region. As a result of being realized identically, the same spring forces acting upon the contact element are obtained for the first and the second contact spring. Reliable contacting of both contact springs by the contact element is thereby easily ensured.

In a preferred configuration, a separating rib extends between the support region of the first contact spring and the support region of the second contact spring. In a preferred configuration, the separating rib is part of the first assembly. An electrical separation of the two contact springs in the support region is thereby easily ensured. Since the first and/or the second contact spring are/is held on the support region and in the fastening region, and consequently the position of the contact spring is defined, a contact of the first and the second contact springs in the free-springing spring region is easily avoided. In this case, advantageously, in the case of the forces acting on the contact springs during operation, the first and the second contact spring are not elastic, or are only slightly elastic, transversely to the separating plane, in the direction of the respectively other contact spring.

In a preferred configuration, the work apparatus has an internal combustion engine. The internal combustion engine advantageously includes an ignition device, which can be connected to ground via the switch. The switch is accordingly an ignition switch of the internal combustion engine. The work apparatus advantageously has a carburetor for supplying a fuel/air mixture to the internal combustion engine. An operating-mode selector is advantageously provided for setting at least one start position. In particular, the internal combustion engine is part of the first assembly, and the carburetor and the operating-mode selector are advantageously part of the second assembly. The carburetor and the operating-mode selector are accordingly separated from one another via the vibration gap, and during operation execute relative movements in relation to one another. Advantageously, the operating-mode selector carries the second contact element. Advantageously, the second contact element is arranged on the operating-mode selector. Instead of fuel being supplied via a carburetor, the supply of fuel may also be effected in a different manner, for example via an electromagnetic valve or similar. The internal combustion engine is, in particular, a two-stroke engine. Two-stroke engines are excited to vibrate by the operation of the engine.

In a first advantageous configuration variant, it is provided that the operating-mode selector is mounted on a handle housing. The handle housing is part of the second assembly. The vibration gap bridged by the switch in this case is a vibration gap between the handle housing and the engine housing.

In an advantageous alternative configuration, it is provided that the work apparatus has a third assembly. The third assembly has a handle housing. The vibration gap formed between the first assembly and the second assembly is a first vibration gap. The first vibration gap advantageously extends between the carburetor and the internal combustion engine, or the engine housing. Advantageously, the first vibration gap is bridged by at least one antivibration element, which may be realized partially or entirely as a rubber buffer, or which contains felt, metal mesh or similar.

Formed between the third assembly and the first assembly there is a second vibration gap. The second vibration gap is bridged by at least one antivibration element, which may include, for example, a steel spring. The second vibration gap is a vibration gap between the handle housing and the internal combustion engine, or engine housing. The switch in this case bridges the first vibration gap between the carburetor and the engine housing. In this configuration variant, the second vibration gap, formed between the handle housing and the first assembly, is advantageously not bridged by the switch.

Advantageously, the operating-mode selector carries the second contact element. The operating-mode selector is preferably of plastic. The second contact element is preferably fastened to the operating-mode selector. When the switch is closed, the second contact element advantageously bears against the spring region of the first contact element. Particularly preferably, when the switch is closed the second contact element bears against the spring region of the first contact element and against the spring region of the third contact element.

Advantageously, the second contact element is connected to the operating-mode selector in a form-fitting manner. For the purpose of securing the second contact element in a form-fitting manner, it is advantageously provided that the second contact element has an opening. A lug of the operating-mode selector, which secures the second contact element in a form-fitting manner, advantageously projects through the opening. Securing of the second contact element to the operating-mode selector is thereby easily achieved. The operating-mode selector advantageously has a stop portion by which it acts on the stop, via the fastening portion of the second contact element. It may also be provided that the operating-mode selector acts directly on the stop portion via the stop portion.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
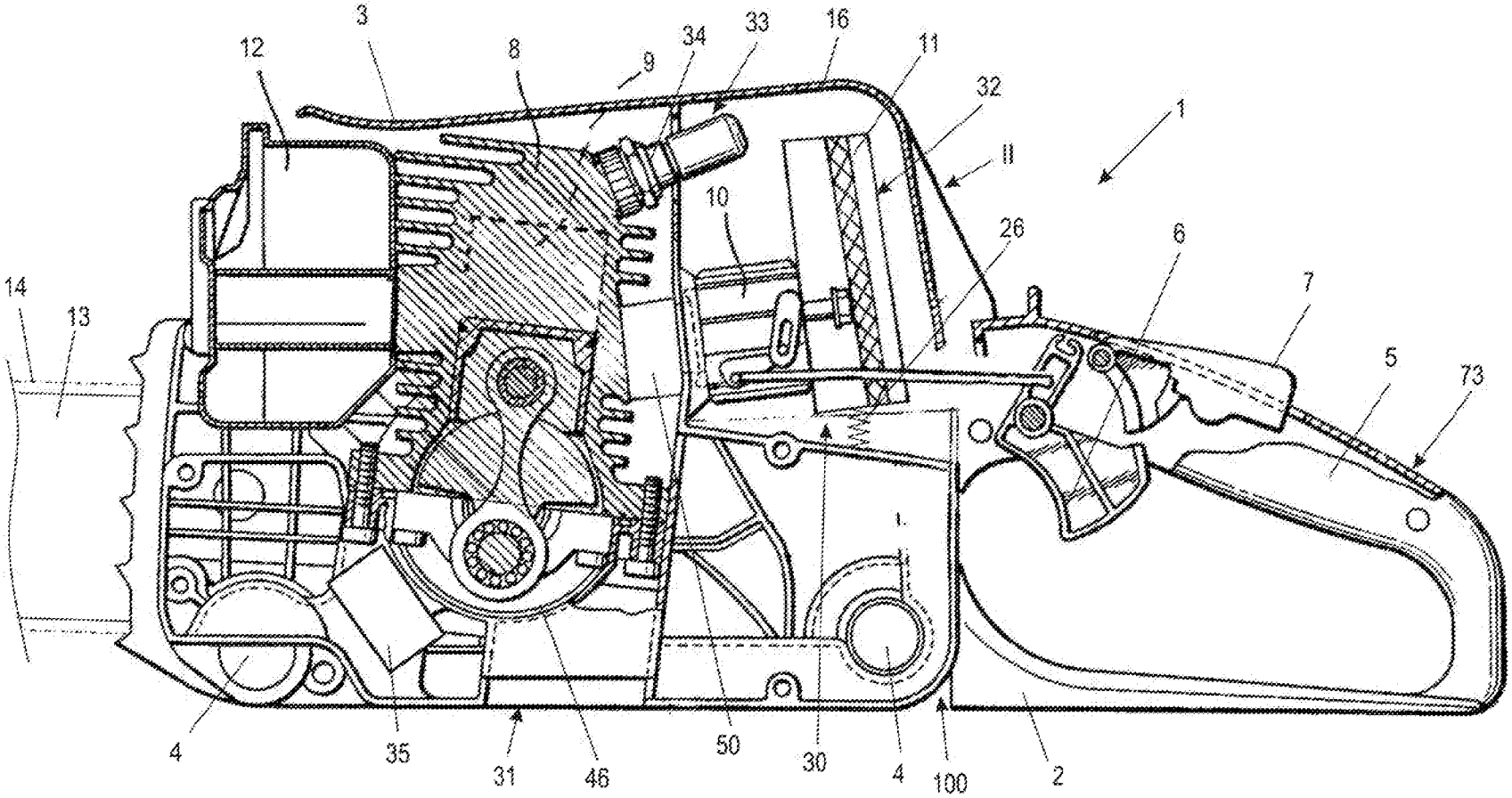
FIG. 1 is a schematic representation of a first embodiment of a handheld work apparatus.

Shown schematically in FIG. 1 is an embodiment of a handheld, engine-driven work apparatus, a power saw 1. The power saw 1 has a handle housing 2 and an engine housing 3. The handle housing 2 includes a rear handle 5, on which a throttle trigger 6 and a throttle-trigger lock 7 are pivotally mounted. The handle housing 2 is connected to the engine housing 3 via antivibration elements 4, of which two are shown schematically in FIG. 1. The antivibration elements 4 allow relative movements between the handle housing 2 and the engine housing 3, and bridge a vibration gap 100 formed between the handle housing 2 and the engine housing 3. Arranged in the engine housing 2 is an internal combustion engine 8, which is fixedly mounted on the engine housing 3. The internal combustion engine 8 has a combustion chamber 9 and an ignition spark plug 34, which is controlled by an ignition module 35, shown schematically in FIG. 1. The ignition module 35 and the ignition spark plug 34 are part of an ignition device 33 of the power saw 1. There is an exhaust muffler 12 for exhaust gases arranged on the internal combustion engine 8. The internal combustion engine 8 drives a saw chain 14, represented schematically in FIG. 1. The saw chain 14 is guided in a revolving manner on a guide bar 13.

For the purpose of supplying a fuel/air mixture, the internal combustion engine 8 has a carburetor 10, which is connected to the internal combustion engine 8 via an elastic connecting piece 50. The connecting piece 50 is advantageously made of elastic material, such that the carburetor 10 and the internal combustion engine 8 are connected such that they are decoupled in respect of vibration. Via an air filter 11, the carburetor 10 draws in air for the admixing of fuel, for the subsequent combustion of the mixture in the combustion chamber 9. The air filter 11 is connected to the engine housing 3 via antivibration elements 26, of which one is represented schematically in FIG. 1. The antivibration element 26 bridges a first vibration gap 30 between the engine housing 3 and the carburetor 10 with the air filter 11. The engine housing 3 has a hood 16, which covers the region of the carburetor 10 and air filter 11, and which is part of the first assembly 31. The carburetor 10 and the air filter 11 are arranged inside the engine housing 3, but are separated from the engine housing 3 via the first vibration gap 30.

The power saw 1 is constructed from three assembles 31, 32 and 73 that can move relative to each other. The first assembly 31 has the engine housing 3, as well as the internal combustion engine 8, fixedly connected to the engine housing 3, the exhaust muffler 12, the guide bar 13 and the saw chain 14. A second assembly 32 has the air filter 11 and the carburetor 10. The first vibration gap 30 is formed between the first assembly 31 and the second assembly 32. A third assembly 73 includes the handle housing 2, with the handle 5 and the throttle trigger 6 and the throttle-trigger lock 7. The third assembly 73 is separated from the first assembly via the second vibration gap 100. The vibration gaps 30 and 100 allow relative movements of the assemblies 31, 32 and 73 in relation to each other.

Figure 2:
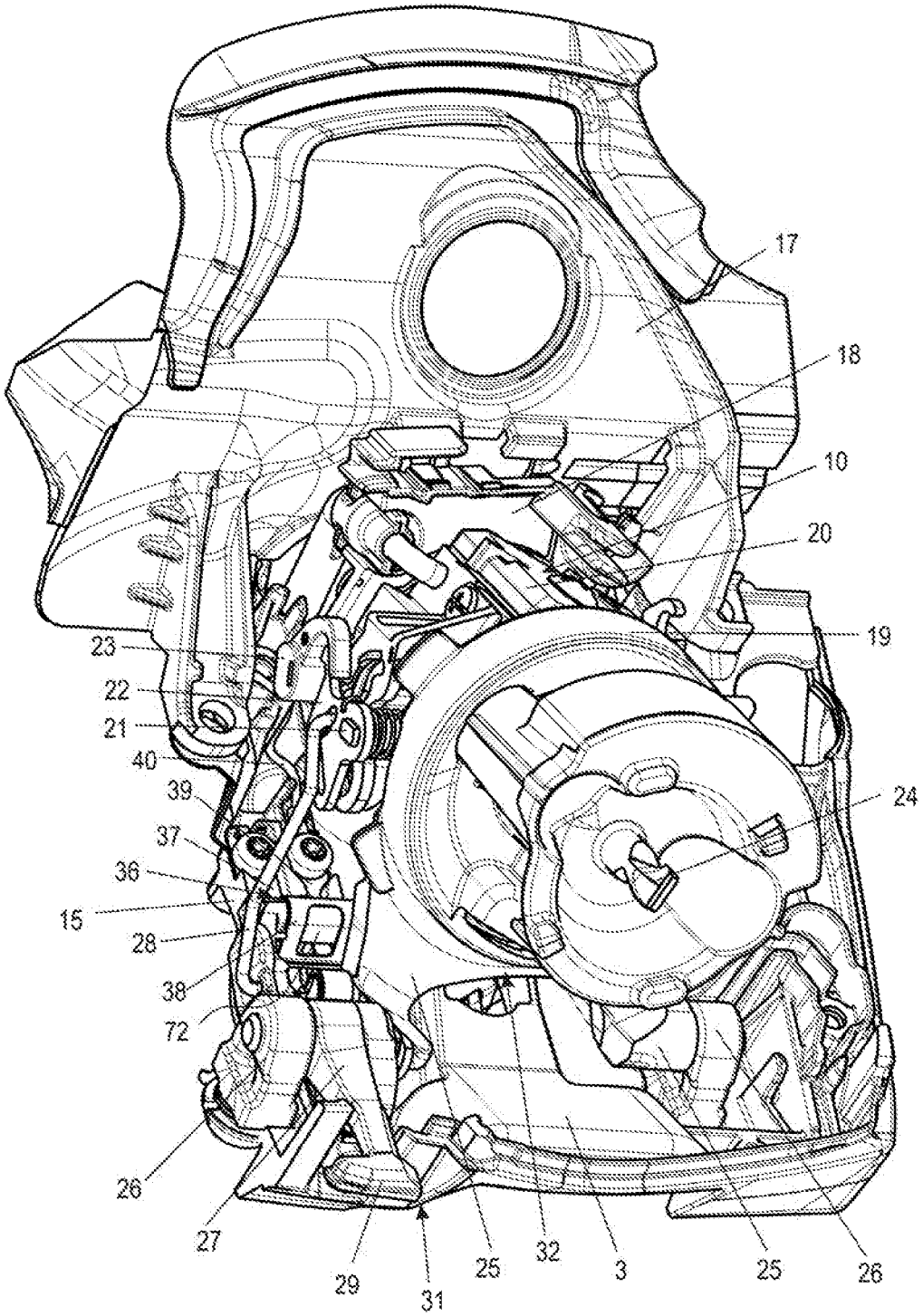
FIG. 2 is a perspective detail representation of the work apparatus in the direction of view of the arrow II in FIG. 1, toward the work apparatus, with the hood removed.
Figure 5:
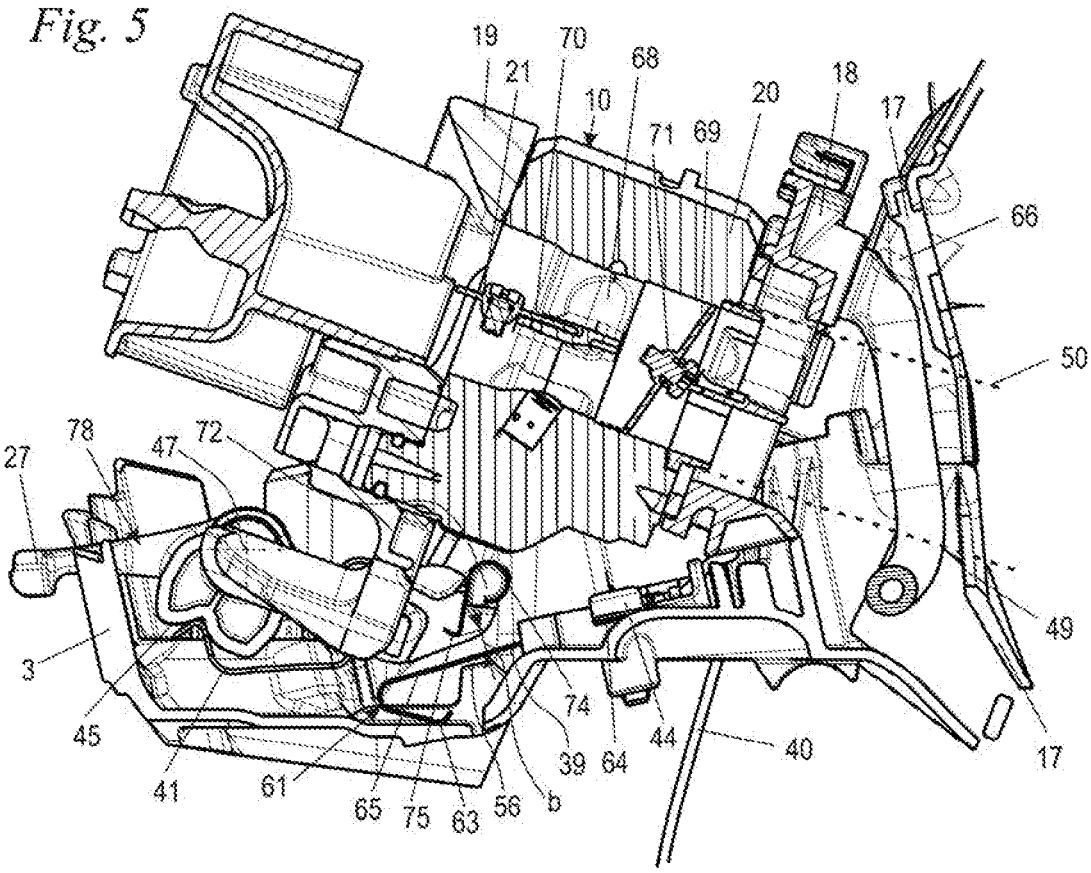
FIG. 5 is a detail schematic, perspective sectional representation through the region of the carburetor of the work apparatus, with the switch open.

FIG. 2 shows the region of the second assembly 32, the hood 16 having been removed. Shown in FIG. 2 is a dividing wall 17, which separates the space in which the internal combustion engine 8 is arranged from the space in which the carburetor 10 and the air filter 11 are arranged. The carburetor 10 has a carburetor housing 20, which is arranged on a carburetor carrier 18. The carburetor carrier 18 is movable relative to the dividing wall 17 and connected, via the connecting piece 50 (FIG. 1), to the internal combustion engine 8 (FIG. 1). The connecting piece 50 in this case projects through an opening 66 in the dividing wall 17, as shown by FIG. 5. An air-filter carrier 19 is arranged on the side of the carburetor housing 20 that faces away from the carburetor carrier 18. A fixing device 24, for fixing a filter element, not shown in FIG. 2, is provided on the air-filter carrier 19. The air-filter carrier 19 is configured for a round filter. Arranged on the air-filter carrier 19 are two arms 25 which, in the embodiment, are realized such that they are integral with the air-filter carrier 19, and which project into the antivibration elements 26. The antivibration elements decouple the air-filter carrier 19 from the engine housing 3, and allow relative movements of the second assembly 32 in relation to the engine housing 3 and the internal combustion engine 8. The antivibration elements 26 are preferably made of an elastomer, particularly preferably of rubber.

As also shown by FIG. 2, an operating-mode selector or actuator 27 is provided, which is likewise part of the second assembly 32, and which is pivotally mounted on one of the arms 25. The operating-mode selector 27 is configured to be actuated by an operator, and an actuating portion 29 thereof projects out of the engine housing 3. The operating-mode selector 27 carries a second contact element 38, which is described in greater detail in the following. A first contact element 37 and a third contact element 39 are fastened to the engine housing 3. The contact elements 37, 38 and 39 form a switch 36. In the embodiment, the switch 36 is a short-circuit switch. The engine housing 3 includes a housing part 15 that advantageously serves to hold the fuel for the internal combustion engine 8. The housing part 15 is arranged in the usual operating position, beneath the carburetor 10 and the air filter 11. The antivibration elements 26 are arranged on the top side of the housing part 15.

In the embodiment, the carburetor 10 has a choke shaft 21, fixed to which, in a rotationally fixed manner, is a choke lever 22. A throttle lever 23 is fixed to a throttle shaft 71 (FIG. 5) that is not shown in FIG. 2. The choke lever 22 and the throttle lever 23 act in combination to set differing start positions of the carburetor 10, preferably a cold-start position and a warm-start position. The start positions can be set via the operating-mode selector 27. The operating-mode selector 27 is advantageously connected to the choke lever 22 via a coupling rod 28. Swiveling of the operating-mode selector 27 adjusts the choke lever 22, which advantageously drives the throttle lever 23, for the purpose of setting a start position of a throttle valve.

An ignition line 40 is terminated to the third contact element 39. The ignition line 40 is connected to the ignition module 35 (FIG. 1). For the purpose of short-circuiting the ignition device 33, the operator actuates the operating-mode selector 27 in such a manner that the second contact element 38 electrically connects the first contact element 37 and the third contact element 39 to each other. The first contact element 37 is connected to ground. In the embodiment, the contact element 37 is connected to the metallic crankcase.

Figure 3:
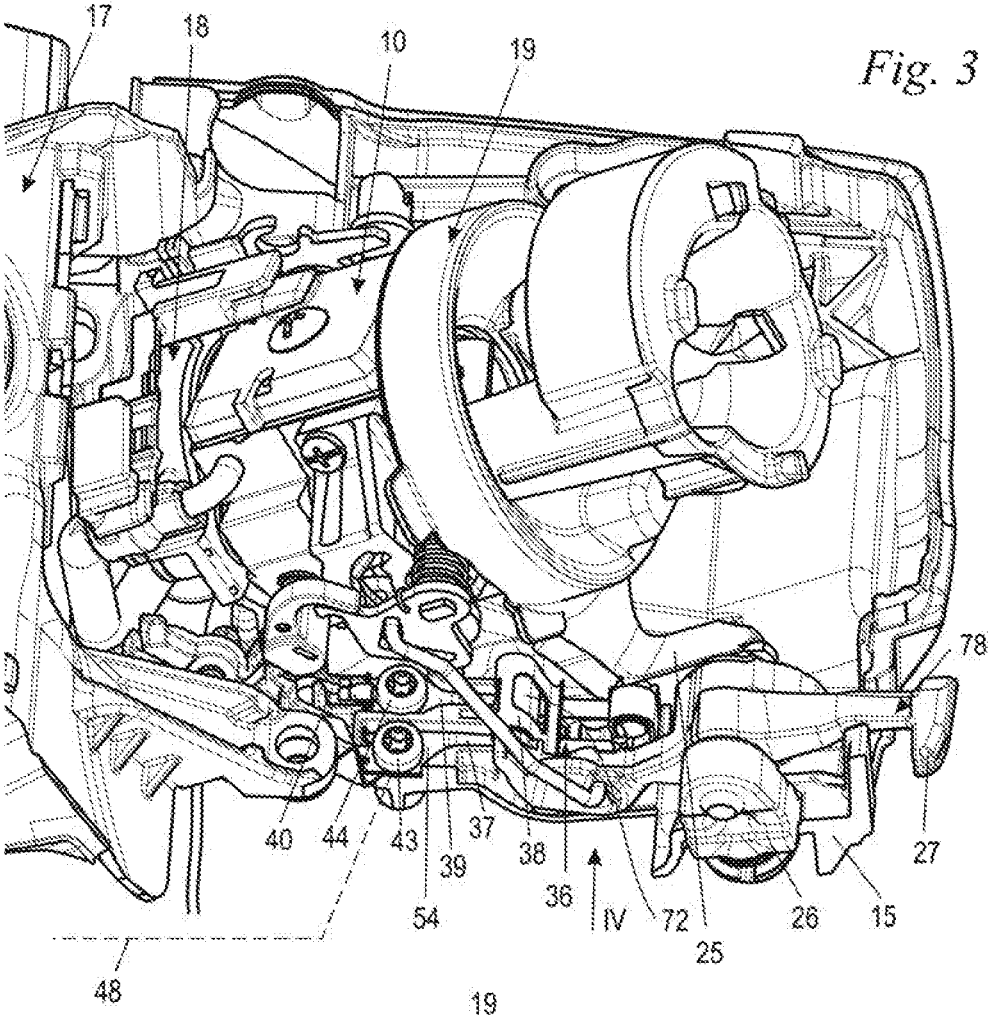
FIG. 3 is a further perspective representation of a detail of the work apparatus, with the hood removed and with the switch open.

As shown by FIG. 3, the first contact element is fixed to a housing part 15 by a first contact screw 43. The housing part 15 delimits the space in which the carburetor 10 is arranged. The electrical contact of the first contact element 37 is effected via a contact plate, not shown, which, for its part, is connected to a crankcase 46 (FIG. 1) of the internal combustion engine 8. This is indicated schematically in FIG. 3 by the broken line 48. The third contact element 39 is fixed to the housing part 15 in an electrically insulating manner by a second contact screw 44. The third contact element 39 is connected to the ignition line 40 in an electrically conductive manner.

Figure 4:
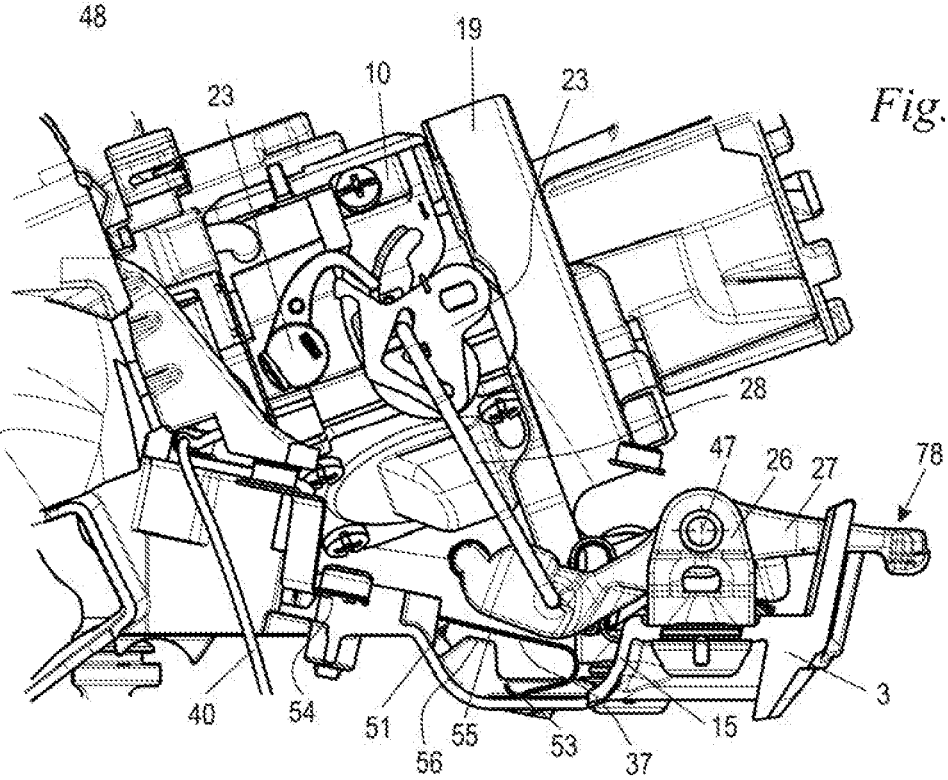
FIG. 4 is a detail side view in the direction of the arrow IV in FIG. 3.

FIG. 3 and FIG. 4 show the operating-mode selector in an operating position 78, in which the switch 36 (FIG. 3) is open. As shown by FIG. 4, the operating-mode selector 27 is mounted such that it can pivot about a pivot axis 47. FIG. 4 also shows the suspension of the coupling rod 28 on the operating-mode selector 27. As also shown by FIG. 4, the ignition line 40 is routed downward, where it is connected to the ignition module 35 (FIG. 1). The first contact element 37 is formed by a first contact spring 51. The first contact spring 51 is realized as an elongate, thin bent sheet. The first contact spring 51 is made of metal. The first contact spring 51 has a support region 53, by which it is supported on the housing part 15. In a fastening region 54, which is also shown in FIG. 3, the first contact spring 51 is fixed, exemplarily, to the housing part 15. Extending between the fastening region 54 and the support region 53 of the contact spring 51 is a spring region 55, in which the first contact spring 51 is realized such that it is free-springing. As also shown by FIG. 4, a stop 56 is realized on the housing part 15. The stop 56 defines an end position of the operating-mode selector 27 when the switch 36 is closed.

FIG. 5 shows a view of the side that is at the rear in FIG. 4. Consequently, visible in FIG. 5 is a second contact spring 61, which forms the third contact element 39. The second contact spring 61, also, is realized as an elongate, bent thin sheet. The second contact spring 61 is made of metal. The second contact spring 61 advantageously has a support region 63 of the second contact spring 61, by which the contact spring 61 bears against the housing part 15. The second contact spring 61 advantageously has a free-springing spring region 65 of the second contact spring 61. In a fastening region 64, the second contact spring 61 is fixed to the housing part 15. The support region 63 of the second contact spring 61 is advantageously realized such that it is identical to the support region 53 of the first contact spring 51. The spring region 65 of the second contact spring 61 is advantageously realized such that it is identical to the spring region 55 of the first contact spring 51. The fastening region 54 of the first contact spring 51 advantageously differs from the fastening region 64 of the second contact spring 61, such that sufficient space remains for the first contact screw 43, or the second contact screw 44, and the first contact element 37 and the second contact element 38 can nevertheless be arranged directly next to each other.

As shown by FIG. 5, the second contact element 38 has a spring region 75, which is configured to establish the electrical contact to the first contact element 37 and to the third contact element 39. When the switch 36 is open, the free-springing spring region of the third contact element 39 has a distance b from the spring region 75 of the second contact element 38. The distance b is advantageously approximately 1.5 times to 3 times the maximum relative movement between the first assembly 31 and the second assembly 32 in the region in which the first contact spring 51 is arranged. A relative movement that differs in maximum extent can be obtained in differing regions of the power saw 1 by the arrangement of the antivibration elements 26. The maximum relative movement in this case is the difference in travel that is executed by the first assembly 31 relative to the second assembly 32 at the first contact spring 51, between their two maximum positions.

As also shown by FIG. 5, the second contact element 38 is formed by a contact spring 60, which is realized as a thin bent metal-sheet part, which has a fastening portion 74 and a spring region 75. In the fastening region 74, the second contact element 38 encompasses a stud 72 of the operating-mode selector 27. The spring region 75 projects away from the stud 72 in the direction of the spring region 55 of the first contact spring 51 and the second spring region 65 of the second contact spring 61. The stud 72 is also shown in FIG. 2 and FIG. 3.

FIG. 5 also shows the configuration of the carburetor 10. The carburetor housing 20 of the carburetor 10 is represented schematically in this case. Realized in the carburetor housing 20 of the carburetor 10 is an intake-channel portion 68, in which, advantageously, a choke valve 70, with the choke shaft 21, is pivotally mounted. A throttle valve 69 is pivotally mounted in the intake-channel portion 68 with a throttle shaft 71. A throttle lever 23 (FIG. 2) is fixed to the throttle shaft 71.

As also shown by FIG. 5, the operating-mode selector 27 advantageously has a latching cam contour 45, against which there bears a latching spring 41. The latching spring 41 is held on an arm 25 of the air-filter carrier 19, and defines latching positions of the operating-mode selector 27. The latching spring 41 serves to position the operating-mode selector 27 in a defined manner. In the open position of the switch 36, shown in FIGS. 5 and 6, the latching spring 41 lies in a latching recess 42 of the latching cam contour 45. When the switch 36 is open, the operating-mode selector 27 is in a stable position, namely, in the operating position 78.

Figure 6:
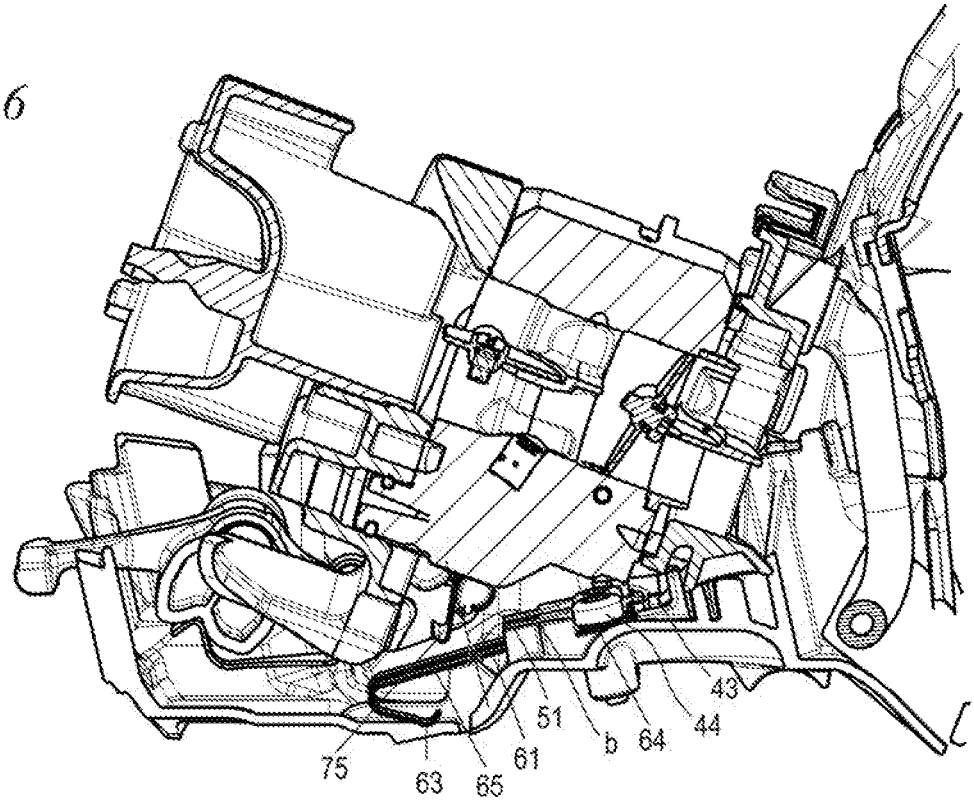
FIG. 6 is a sectional representation of the region from FIG. 5.

FIG. 6 shows the arrangement of the two contact springs 51 and 61 next to each other. When the switch 36 is open, the contact springs 51 and 61 advantageously have the same distance b from the spring region 75 of the second contact element 38.

As also shown by FIG. 6, there is a separating rib 59 arranged between the support region 53 of the first contact spring 51 and the support region 63 of the second contact spring 61. In the embodiment, the separating rib 59 is formed on the housing part 15. The separating rib 59 extends between the support regions 53 and 63, and thereby effects an electrical separation of the contact springs 51 and 61.

Figure 7:
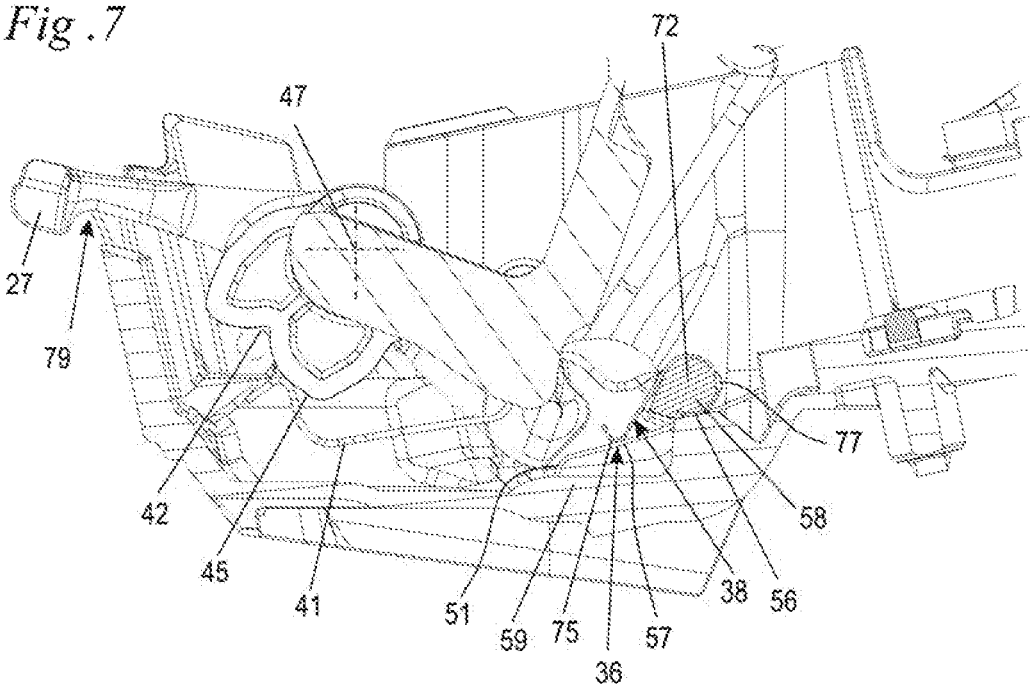
FIG. 7 is an enlarged detail sectional representation of the work apparatus, with the switch closed.
Figure 8:
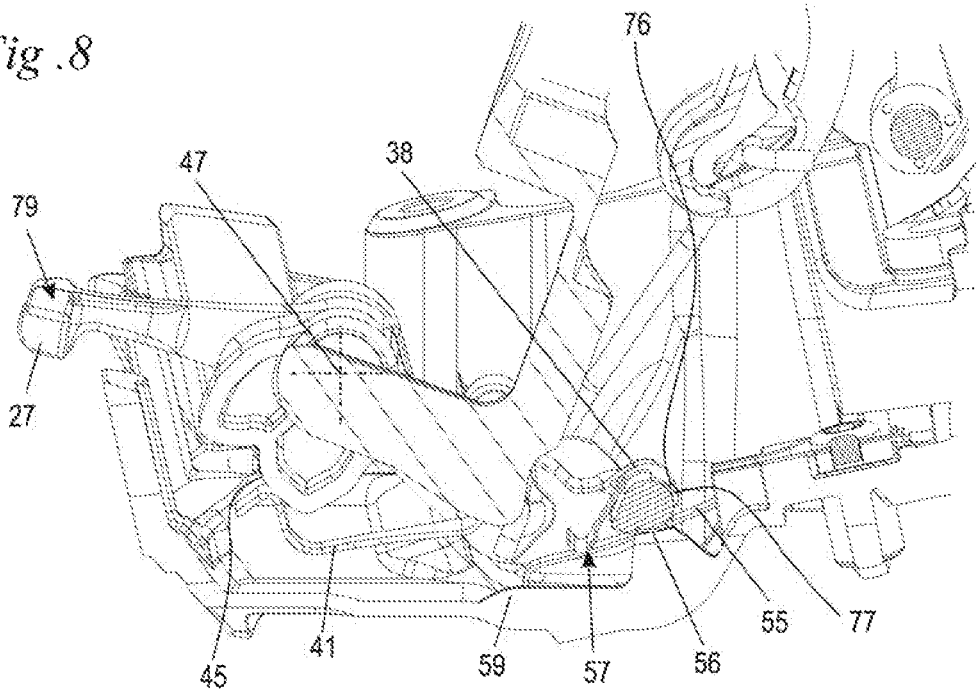
FIG. 8 is the arrangement from FIG. 7, in a perspective representation.

FIGS. 7 and 8 show a section through the separating rib 59. The second contact spring 61 located behind it is likewise shown.

Figure 9:
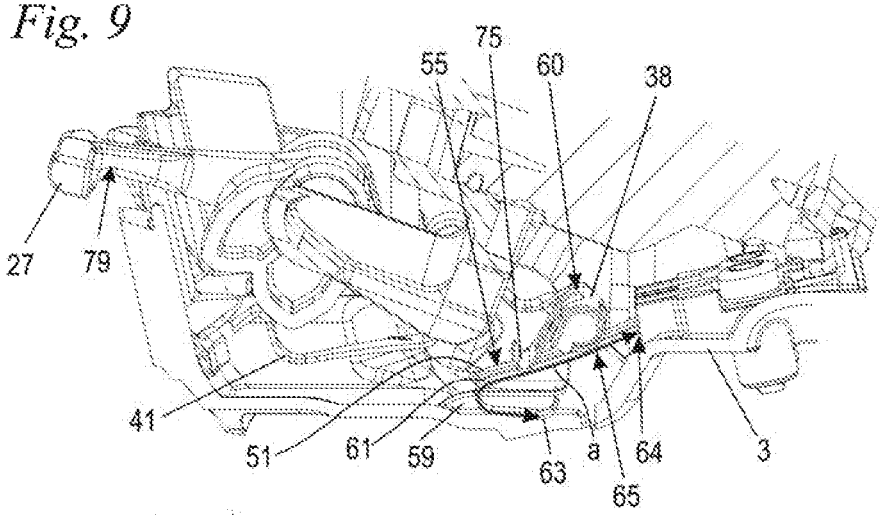
FIG. 9 is a perspective detail representation, in a further sectional plane, with the switch closed.
Figure 10:
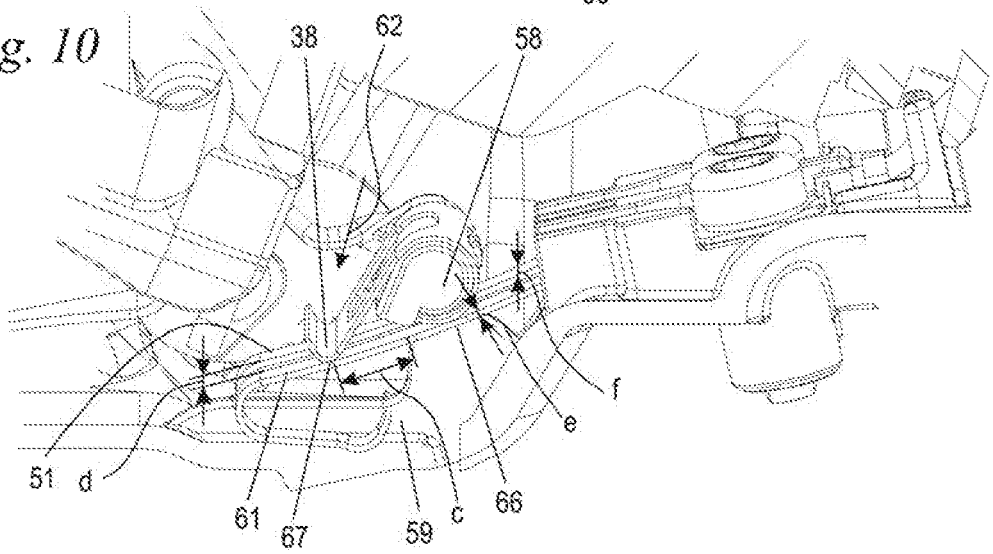
FIG. 10 is an enlarged representation of a region from FIG. 9.

FIGS. 9 and 10 show a section in the direction of view in front of the contact spring 51, such that both contact springs 51 and 61 are visible in FIGS. 9 and 10.

FIGS. 7 to 10 show the switch 36 in the closed state. The operating-mode selector 27 is in a stop position. The stop position 79 may be a stable position of the operating-mode selector 27. In an advantageous configuration, the operating-mode selector 27 is realized as a pushbutton, and springs, as soon as it is released by the operator, back from stop position 79 into the operating position 78. Following actuation of the switch 36 by the operator, the ignition of the internal combustion engine 8 is interrupted, that is, the ignition spark plug 34 (FIG. 1) is no longer ignited, and the internal combustion engine 8 is switched off.

When the operating-mode selector 27 is in the stop position 79, the spring region 75 of the contact element 38 lies on a contact region 57 of the first contact spring 51 (FIG. 7) and, as shown by FIG. 10, on a contact region 67 of the second contact spring 61, and thereby connects the contact springs 51 and 61 to each other in an electrically conductive manner. This can be seen, in particular, in FIGS. 9 and 10.

As shown by FIGS. 7 and 8, the operating-mode selector 27 has a stop portion 58, which can act in combination with the stop 56 when the operating-mode selector 27 is in the stop position 79. Depending on the position of the assemblies 31 and 32 in relation to each other, the stop portion 58 can also have a distance from the stop 56 when the operating-mode selector 27 is in the stop position 79. In the stop position 79, the second contact element 38 bears against the contact elements 37 and 39 (FIG. 3) and connects them in an electrically conductive manner. For this purpose, the second contact element 38, which is held on the operating-mode selector 27, has the spring region 75, which contacts the contact elements 37 and 39.

The sectional representation in FIGS. 7 and 8 shows only the first contact spring 51 of the first contact element 37. In the embodiment, the stop portion 58 acts on the stop 56 via the second contact element 38. It may also be provided, however, that the stop portion 58 acts directly on the stop 56. Further movement of the stop portion 58, and therefore also of the second contact element 38, in the direction of the first contact spring 51 and the second contact spring 61 (FIG. 9) is thereby avoided. Inadmissible plastic deformation of the contact springs 51 and 61 can thereby be easily avoided.

As also shown by FIGS. 7 and 8, the second contact element 38 is held on the operating-mode selector 27 in a form-fitting manner. For this purpose, there is a lug 77 formed on the stud 72 which, in the embodiment, also forms the stop portion 58. The lug 77 projects through an opening 76 in the second contact element 38. The second contact element 38 is bent according to the outer contour of the stud 72, and is thereby held on the stud 72. The lug 77 effects additional securing of the second contact element 38 in a direction parallel to the pivot axis 47 of the operating-mode selector 27.

FIGS. 9 and 10 show the operating-mode selector 27 in the stop position 79, both contact springs 51 and 61 being shown in the represented sectional plane. As shown by FIG. 9, the second contact spring 61 has a length a from the fastening region 64 to the support region 63. The spring region 65, in which the second contact spring 61 is realized in a free-springing manner, extends over the length a. The length a is advantageously at least 10 mm, in particular at least 15 mm, advantageously at least 20 mm. The first contact spring 51 is realized accordingly, and the spring region 55 has a corresponding length a, not indicated in FIG. 9. The contact springs 51 and 61 have a hook-shaped or walking-stick shaped form, having a bend between a first straight region, which adjoins the fastening region 54, 64, and a second straight region, which adjoins the support region 53, 63. The straight region adjoining the fastening region 54, 64 in this case is longer than the straight region adjoining the support region 53, 63. At the support region 53, 63, the contact springs 51, 61 are each realized in a bent manner, such that linear support of the engine housing 3 is achieved. Owing to the defined linear support, a defined spring behavior and, as compared with a flat support, a reduced susceptibility to contamination are obtained.

As shown by FIG. 10, the contact springs 61 and 51 are separated by a distance d from each other. The contact springs 61 and 51 each have a thickness e and a width f. When the switch 36 is in the closed state, the second contact element bears against the broad side of the contact springs 51 and 61, that is, against the side having the width f. The width f is measured transversely in relation to a direction of movement 62 of the second contact element 38. In the direction of movement 62, the contact springs 51 and 61 have a thickness e, which is significantly less than the width f. In the embodiment, the width f is at least 1.5 times, preferably at least double, the thickness e, in particular at least 5 times the thickness e. The distance d may advantageously be 0.5 times to 3 times the width f. The contact region 57 of the first contact spring 51, in which the second contact element 38 comes into contact with the first contact spring 51, has a distance c from the stop 56, measured along the first contact spring 51. The distance c is advantageously 0.5 times to 2 times the width f. The distance c is advantageously at least double, in particular at least 5 times, the thickness e. In an alternative configuration, however, it may also be provided that the contact region 57 is arranged in the region of the stop 56. In the embodiment, the stop 56 projects between the two contact springs 51 and 61. The stop 56 is realized as an extension of the separating rib 59. However, a lateral arrangement of the stop 56, that is, on the side of the second contact spring 61 that faces away from the first contact spring 51, or on the side of the first contact spring 51 that faces away from the second contact spring 61, may also be advantageous. The contact springs 51 and 61 are realized such that they are the same in respect of the thickness e, the width f and the distance c from the stop 56, such that the above statements apply respectively to both contact springs 51 and 61.

Upon the operating-mode selector 27 being shifted out of the operating position 78 (FIG. 5) and into the stop position, the spring region 75 of the second contact element 38 slides from the first contact of the spring region 75 with the first contact spring 51 until the stop 56 is reached, on the contact region 57 of the first contact spring 51 (FIGS. 7 and 8). In a corresponding manner, the spring region 75 slides on the contact region 67 of the second contact spring 61 (FIGS. 9 and 10). As a result of the surfaces sliding on one another, cleaning of the contact faces occurs upon each switching operation. The sliding of the spring region 75 of the second contact element 38 on the contact region 57 of the first contact spring 51 and on the contact region 67 of the second contact spring 61 is made possible by the arrangement of the contact springs 51 and 61, by the direction in which the contact springs 51 and 61 are elastically deformable, and by the direction of movement 62 in which the second contact element 38 moves during the switching operation.

FIGS. 1 to 10 show an embodiment in which the switch 36 bridges a vibration gap 30 between the first assembly 31 and a second assembly 32. A second vibration gap 100 is also realized in this case, between a handle housing 2 and the engine housing 3.

Figure 11:
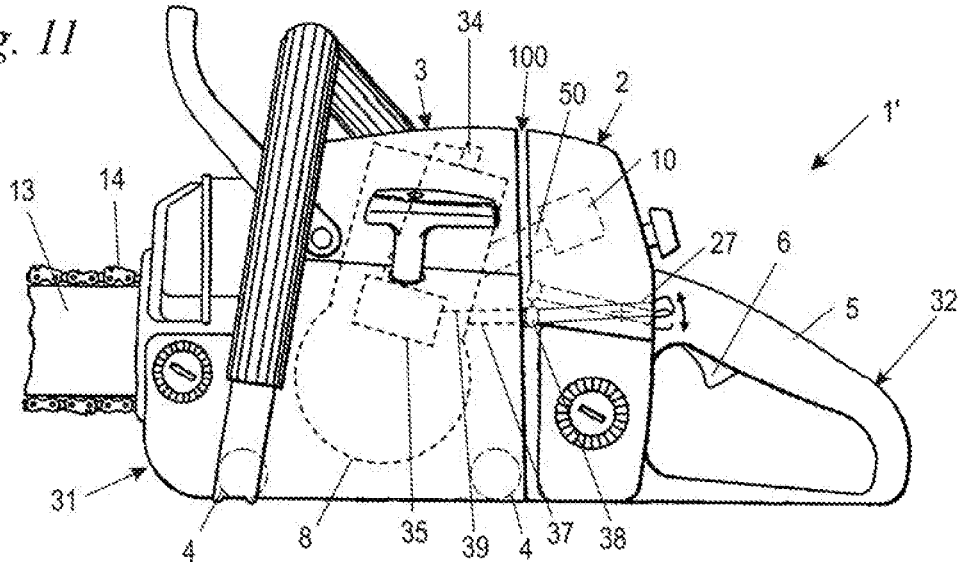
FIG. 11 is a schematic side view of a further embodiment of a work apparatus.

The embodiment according to FIG. 11 shows a different configuration. In the case of the power saw 1' represented schematically in FIG. 11, the second assembly 32 includes the handle housing 2. A third assembly is not provided. The switch 36 bridges the vibration gap 100, which is formed between the first assembly 31, which includes the engine housing 3, and the second assembly 32, which includes the handle housing 2. The configuration of the operating-mode selector 27 and of the contact elements 37, 38 and 39, which is represented only schematically in FIG. 11, may be provided according to the configuration for the preceding embodiment. Corresponding elements are denoted by the same references as in the preceding figures.

Figure 12:
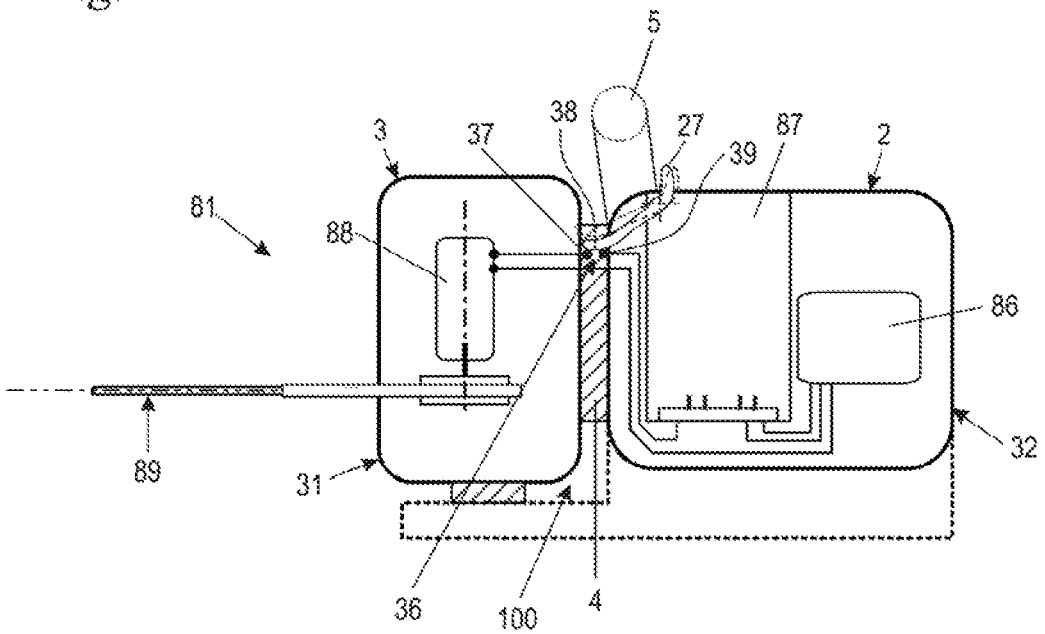
FIG. 12 is a schematic representation of a further embodiment of a work apparatus.

FIG. 12 shows an embodiment of a hedge cutter 81. The hedge cutter 81 does not have an internal combustion engine 8, but an electric motor 88 for driving a tool 89. In the case of the hedge cutter 81, the tool 89 is constituted by a cutter bar, the cutters being driven back and forth by the electric motor 88. The electric motor 88 is part of a first assembly 31, which also includes the motor housing 3. The hedge cutter 81 has a second assembly 32, which includes a handle housing 2. Fixed to the handle housing 2 is a handle 5 which, in the embodiment, is realized as a tubular handle. The vibration gap 100, which is bridged by antivibration elements 4, is formed between the first assembly 31 and the second assembly 32. A battery 87 and a control device 86 are arranged in the handle housing 2. The control device 86 serves to control the electric motor 88, and may also be configured to control the battery 87. The hedge cutter 81 has a switch 36, which is formed by a first contact element 37, a second contact element 38 and a third contact element 39. In the embodiment, the first contact element 37 is provided on the motor housing 3, that is, on the first assembly 31. The third contact element 39 is provided on the handle housing 2, that is, on the second assembly 32. The second contact element 38 is arranged and pivotally mounted on the operating-mode selector 27.

When the switch 36 is in the closed position shown in FIG. 12, the contact element 38 connects the contact elements 37 and 39 to each other in an electrically conductive manner, such that the electric motor 88 can be supplied with energy via the battery 87 and can be controlled via the control device 86. If the operating-mode selector 27 is shifted into the position represented by a broken line in FIG. 12, the switch 36 is opened, and the contact elements 37 and 39 are not connected to each other in an electrically conductive manner via the contact element 38. Consequently, it is not possible for the electric motor 88 to be driven when the switch 36 is in the open position.

The embodiment according to FIG. 12 differs from the preceding embodiments in that the first contact element 37 and the third contact element 39 are not arranged on the same assembly, but on differing assemblies. In the embodiment, the operating-mode selector 27 is part of the second assembly 32. However, a configuration in which the operating-mode selector 27 is part of the first assembly 31 may also be advantageous.

In all embodiments, the switch 36 may have one or more stable switching positions. It may also be provided, however, that the operating-mode selector 27 is realized, at least for one switching position, as a pushbutton that, after having been released, shifts back into its initial, non-actuated, position. The non-actuated initial position in this case is, in particular, the operating position 78 of the operating-mode selector 27. In the embodiment according to FIGS. 1 to 10, the return to the operating position 78 is effected by the latching spring 41 and by the configuration of the latching cam contour 45. When the switch 36 is in the closed position, shown in FIGS. 7 to 10, and the operating-mode selector 27 is in the stop position, the latching spring 41, via the latching cam contour 45, exerts upon the operating-mode selector 27 a force that, upon release of the operating-mode selector 27 by the operator, shifts the operating-mode selector 27 back into the operating position 78 of the operating-mode selector 27 shown in FIGS. 4 to 6 and into the open position of the switch 36.

It is understood that the foregoing description is that of the preferred embodiments of the invention and that various changes and modifications may be made thereto without departing from the spirit and scope of the invention as defined in the appended claims.

What is claimed is:

1. A handheld work apparatus comprising:

an anti-vibration element;

a first assembly;

a second assembly movably mounted with respect to said first assembly via said anti-vibration element;

said first assembly and said second assembly conjointly defining a vibration gap therebetween;

said anti-vibration element bridging said vibration gap;

a switch configured to be actuated by an operator;

said switch including at least one first contact element and at least one second contact element, wherein said at least one first contact element and said at least one second contact element are in contact when said switch is closed and said at least one first contact element and said at least one second contact element have no electrically conducting contact therebetween when said switch is open;

said second contact element being part of said second assembly;

at least one of said at least one first contact element being part of said first assembly; and, said at least one first contact element and said at least one second contact element being configured to bridge said vibration gap when said switch is closed.

2. The handheld work apparatus of claim 1, wherein said at least one first contact element is formed by a first contact spring.

3. The work apparatus of claim 2, wherein:

said first contact spring has a support region formed thereon; and, said first contact spring supports itself on said first assembly via said support region.

4. The handheld work apparatus of claim 2, wherein:

said first contact spring has a fastening region formed thereon; and, said first contact spring is fixed on said first assembly via said fastening region.

5. The handheld work apparatus of claim 4, wherein said first contact spring is formed as an elongated metal sheet.

6. The handheld work apparatus of claim 5, wherein:

said first contact spring has a support region formed thereon;

said first contact spring supports itself on said first assembly via said support region; and, said at least one first contact element acts on said first contact spring in a longitudinal extent of said first contact spring between said support region and said fastening region.

7. The handheld work apparatus of claim 2, wherein said first assembly has a stop for said second contact element formed thereon.

8. The handheld work apparatus of claim 7, wherein:

said first contact spring has a spring region including a contact region;

said at least one second contact element is configured to come into contact with said first contact spring at said contact region;

said first contact spring defines a longitudinal extent; and, said contact, in the direction of said longitudinal extent thereof, has a distance (c) to said stop.

9. The handheld work apparatus of claim 1, wherein:

said switch is a short-circuit switch;

said at least one first contact element, in an open state of said short-circuit switch, is at a distance (b) to said at least one second contact element; and, said distance (b) corresponds to approximately 1.5 to 3 times a maximum relative movement between said first assembly and said second assembly at said first contact element.

10. The handheld work apparatus of claim 1, wherein:

said switch has a third contact element;

said third contact element is part of said first assembly; and, said third contact element is connected to said at least one first contact element in an electrically conducting manner via said at least one second contact element when said switch is closed.

11. The handheld work apparatus of claim 10, wherein:

said at least one contact element includes a first contact spring;

said first contact spring has a first support region and a fastening region formed thereon;

said third contact element is formed by a second contact spring;

said second contact spring has a second support region formed thereon and a second fastening region formed thereon;

said second contact spring is supported on said first assembly via said second support region; and, said second contact spring is fixed on said first assembly at said second fastening region.

12. The handheld work apparatus of claim 11 further comprising a separating rib running between said first support region of said first contact spring and said second support region of said second contact spring.

13. The handheld work apparatus of claim 1 further comprising:

a combustion engine having an ignition device;

said ignition device being connectable to ground;

a carburetor configured to supply a fuel/air mixture to said combustion engine;

an operating mode selector for setting at least a starting position for said carburetor;

said combustion engine being part of said first assembly; and, said operating mode selector and said carburetor being part of said second assembly.

14. The handheld work apparatus of claim 13 further comprising:

said second assembly including a handle housing;

said operating mode selector being mounted at said handle housing; and, said vibration gap bridged by said switch being a vibration gap between said handle housing and said combustion engine.

15. The handheld work apparatus of claim 13 further comprising:

a third assembly including a handle housing;

said anti-vibration element being a first anti-vibration element;

said vibration gap between said first assembly and said second assembly being a first vibration gap;

said third assembly and said first assembly conjointly defining a second vibration gap therebetween; and, a second anti-vibration element bridging said second vibration gap.

16. The handheld work apparatus of claim 13, wherein said operating mode selector carries said at least one second contact element.

17. The handheld work apparatus of claim 16, wherein:

said at least one second contact element defines a cutout therein; and, said operating mode selector has a nose projecting into said second contact element and secures said at least one second contact element in a form-fitting manner.

18. The handheld work apparatus of claim 13, wherein:

said first assembly has a stop for said at least one second contact element formed thereon; and, said operating mode selector includes a stop section acting on said stop.

* * * * *